US012396492B2

(12) United States Patent
Fung

(10) Patent No.: US 12,396,492 B2
(45) Date of Patent: Aug. 26, 2025

(54) FASTENER FOR GARMENT

(71) Applicant: MULTI TREND CORPORATION LIMITED, Kowloon (HK)

(72) Inventor: Wing Leung Fung, Kowloon (HK)

(73) Assignee: MULTI TREND CORPORATION LIMITED, Kowloon (HK)

( * ) Notice: Subject to any disclaimer, the term of this patent is extended or adjusted under 35 U.S.C. 154(b) by 14 days.

(21) Appl. No.: 18/207,403

(22) Filed: Jun. 8, 2023

(65) Prior Publication Data

US 2024/0407473 A1 Dec. 12, 2024

(51) Int. Cl.
*A41B 9/00* (2006.01)

(52) U.S. Cl.
CPC ..... *A41B 9/001* (2013.01); *A41B 2300/32* (2013.01)

(58) Field of Classification Search
CPC . A41B 9/001; A41B 2300/32; A44B 18/0007; A44B 18/0011; A44B 18/0015; A44B 18/0019; A44B 18/0073; A44B 18/008; A44B 18/0069; A44B 18/00; A44B 18/0096; A44B 18/0023; A44B 18/003; A44B 18/0046; A44B 18/0053; A44B 18/0057; A44B 18/0061; A44B 18/0065; Y10T 24/36
USPC ..... 24/306
See application file for complete search history.

(56) References Cited

U.S. PATENT DOCUMENTS 4,033,348 A * 7/1977 Cepuritis ..... A61F 13/58 24/DIG. 11
5,926,926 A * 7/1999 Kato ..... A61F 13/622 24/442
2002/0023321 A1* 2/2002 Clune ..... A61F 13/625 24/306
2005/0027279 A1* 2/2005 Minato ..... A61F 13/49014 604/387
2005/0131372 A1* 6/2005 Wheeler ..... A61F 13/5605 604/385.04
2016/0058631 A1* 3/2016 Ormsby ..... A61F 13/5644 604/391
2016/0128877 A1* 5/2016 Chandrasekaran ..... A61F 13/58 156/60
2016/0128878 A1* 5/2016 Bonelli ..... B29C 65/48 156/263
2022/0386746 A1* 12/2022 Tang ..... A44B 18/0049

* cited by examiner

*Primary Examiner* — Jack W Lavinder
(74) *Attorney, Agent, or Firm* — Francis J. Maguire; WARE FRESSOLA MAGUIRE & BARBER LLP

(57) ABSTRACT

A fastener for use with undergarment, including a first tape having a body provided with a plurality of first connectors; a second tape having a body provided with a plurality of second connectors for connecting with the first connectors in the first tape; and each of the first and second tapes includes an attachment portion having a retainer adapted for connecting with the undergarment, the first and second connectors are elastic; and a method of forming the same.

20 Claims, 12 Drawing Sheets

FASTENER FOR GARMENT

The present invention relates to a fastener for use with clothing to close off openings, for example particularly, but not exclusively, a hook and eye fastener for undergarment.

BACKGROUND OF THE INVENTION

Conventional hook and eye fastener is a type of closure commonly used in clothing and sewing projects. It consists of two separate pieces: a small hook and a small eye. The hook is typically sewn onto one side of a garment or piece of fabric while the eye is sewn onto another side. The hook is then inserted into the eye to create a secure closure. This type of fastener is often used on the back of dresses, skirts, and blouses. It is a simple and effective alternative to close a garment other than buttons or zippers.

With the eye connector lying flat on the upper surface of an eye tape, it can be difficult for user to insert the hook connector sewed to the hook tape, especially when it is done without looking. It is relatively common to use at least two pairs of hook and eye fasteners to securely close off an opening. It can be difficult to fastener one pair of hook and eye fastener blind folded, not to mention two.

The problem is more profound with the less able such as an elderly who has weak grip and shaky hands. The challenges in using hook and eye fasteners are shared by the disabled and young children.

Hook and eye connectors are usually made from wire or plastic. These materials are relatively hard and may cause discomfort to the skin of a user. This is particularly the case when they are used with undergarments. Cushions have been applied to mask the hardness of the hook and eye connectors from the skin of a user but the fastener becomes very bulky. The bulkiness affects the aesthetic appearance of the undergarment and makes it difficult to conceal.

The invention seeks to eliminate or at least to mitigate such shortcomings by providing a fastener for use with garments.

SUMMARY OF THE INVENTION

In a first aspect of the invention there is provided a fastener for use with undergarment, comprising a first tape having a body provided with a plurality of first connectors; a second tape having a body provided with a plurality of second connectors for connecting with the first connectors in the first tape; and each of the first and second tapes includes an attachment portion having a retainer adapted for connecting with said undergarment; wherein the first and second connectors are self restorable; preferably, the attachment portion is provided at a first end of the tape; more preferably, the retainer of the attachment portion comprises a space defined by upper and lower layers of the attachment portion, the space is configured to receive a part of said undergarment; yet more preferably, the first connectors are provided adjacent the attachment portion. It is preferable that the first connectors and the attachment portion are in connection with a base layer; advantageously, the base layer is formed from a layer of stretchable material; more advantageously, the attachment portion includes a lamination of two layers of materials with different stretchabilities. Yet more advantageously, the first tape includes a gripper portion provided opposite to the attachment portion for manipulating by fingers of a user. In a preferred embodiment, the gripping portion is devoid of the first connectors; preferably, at least a part of the gripping portion includes a layer of stretchable material; preferably, the base layer is movable from a first position in which the first connectors connectors are concealed, to a second position in which the first connectors are exposed; more preferably, the base layer is fixed in position by way of adhesive; it is preferable that the base layer is fixed to the first connection via a support layer; preferably, the first connectors are supported on a backing sheet; more preferably, the attachment portion is sewed onto a backing sheet and the base layer. It is preferable that the first connector comprises self restorable hook connector and the second connector comprises self restorable loop connector for engaging the hook connector. Preferably, the first and second tapes are Velcro™ tapes.

In a second aspect of the invention there is provided a method of manufacturing a first tape as claimed in claim 1 comprising the steps of:

- providing a layer of first self restorable connectors;
- attaching the layer of first self restorable connectors onto a support layer;
- attaching a base layer to at least one of the layer of first self restorable connectors and the support layer at three sides of the base layer;
- moving the base layer from a first position to a second position to simultaneously expose the layer of first self restorable connectors, place the base layer under the support layer and conceal the three sides at which the base layer is attached to the layer of first self restorable connectors and the support layer; preferably, the method further comprises the step of forming a gripping portion adjacent the layer of first self restorable connectors.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Referring to FIGS. 1 to 12B, there is shown two embodiments of a fastener 100 and 200 in accordance with the invention. The fastener 100 or 200 may be used with and undergarment to close off openings. More specifically, it is used with a brasserie.

The fastener 100 or 200 includes a first, hook tape 101/201, and a second, loop tape 102/202, that are reversibly interconnectable. When used with a brasserie, the hook tape 101/201 is attached, for example by way of a seam, to one arm of the brasserie and the loop tape 102/202 is attached, for example by way of a seam, to another arm of the brasserie. Another possible way of attaching the hook and loop tapes 101/102/201/202 to respective arms of the brasserie may involve adhesive or ultrasonic welding. When fastened, hook and loop connectors 101A/201A/102A/202A on the hook and loop tapes 101/102/201/202 connect the arms of the brasserie to form a complete loop.

The hook tape 101/201 of both of the first and second embodiments includes a plurality of hook connectors 101A/201A extending from a backing sheet 101B/201B, which collectively forms a layer of hook connectors. The backing sheet 101B/201B are supported on a base layer 101C/201C. More specifically the layer of hook connectors is attached, directly or indirectly and possibly by way of adhesive, to the base layer 101C/201C for support. An attachment portion 101D/201D is provided at one end of the hook tape 101/201 and adjacent the hook connectors 101A/201A. A gripping portion 101E/201E is provided at another end of the hook tape 101/201 and located opposite to the attachment portion 101D/201D. The gripping proton 101E/201E and the attachment portion 101D/201D are devoid of any hook connectors 101A/201A. A window is defined between the gripping portion 101E/201E and the attachment portion 101D/201D through which the hook connectors 101A/201A are exposed. The attachment portion 101D/201D includes a retainer 101D1/201D1 which is an opened end dimensioned to receive the arm of a brasserie.

The loop tape 102/202 of both of the first and second embodiments include a plurality of loop connectors 102A/202A extending from a backing sheet 102B/202B, which collectively forms a layer of loop connectors. The layer of loop connectors are supported on a base layer 102C/202C. More specifically the layer of loop connectors is attached, directly or indirectly and possibly by way of adhesive, to the base layer 102C/202C for support. An attachment portion 102D/202D is provided at one end of the loop tape 102/202 and adjacent the loop connectors 102A/202A. The attachment portion 102D/202D is devoid of any loop connectors 102A/202A.

The hook connectors 101A/201A and the loop connectors 102A/202A are made of pliable, elastic and/or self-restorable material. An example would be a Velcro™ hook and loop connectors.

Figure 7A:
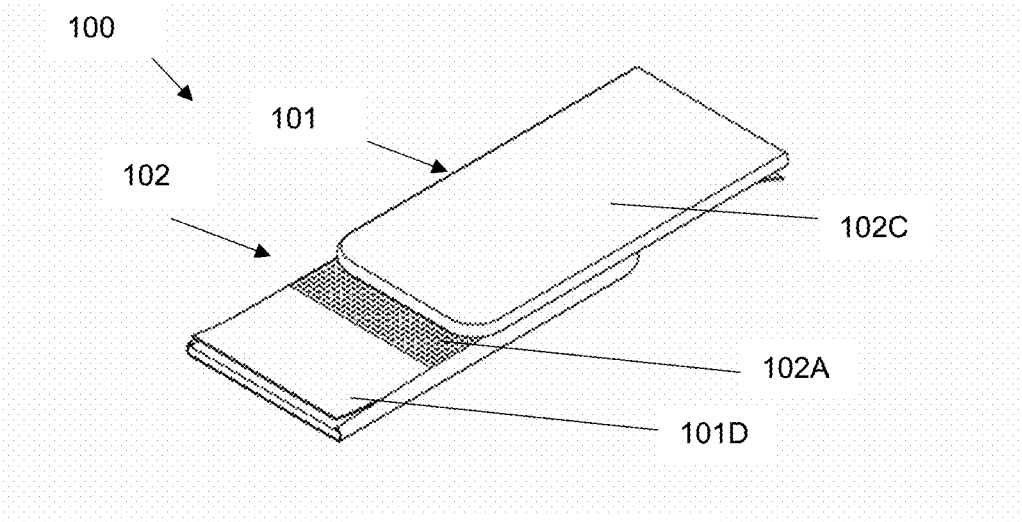
FIG. 7A is an illustrative perspective view showing the hook and loop tapes of the first embodiment of the fastener being fastened.
Figure 7B:
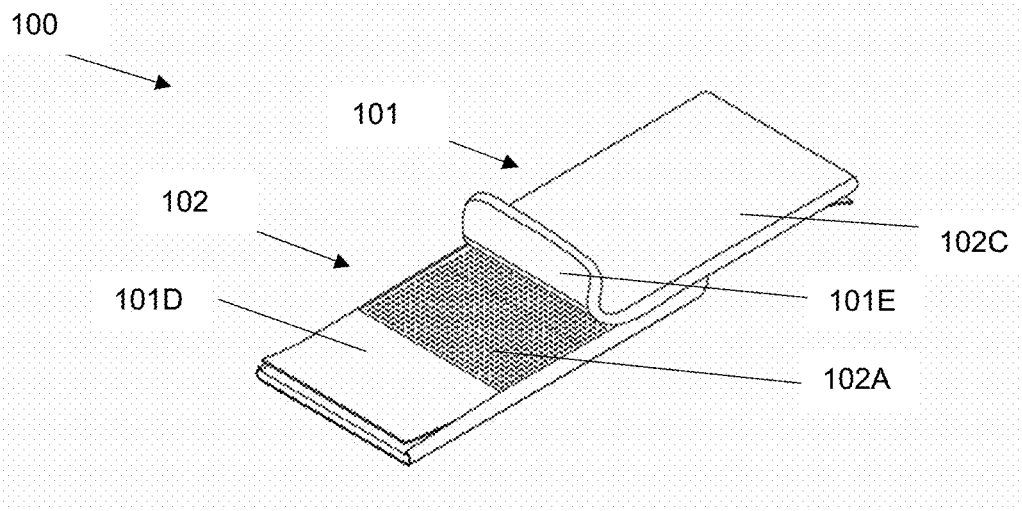
FIG. 7B is an illustrative perspective view showing the fastener in FIG. 7A with a gripping portion being raised.
Figure 12A:
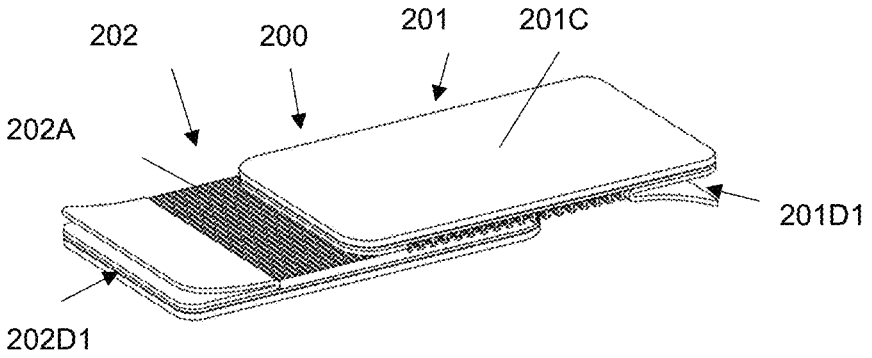
FIG. 12A is an illustrative perspective view showing the hook and loop tapes of the second embodiment of the fastener being fastened.
Figure 12B:
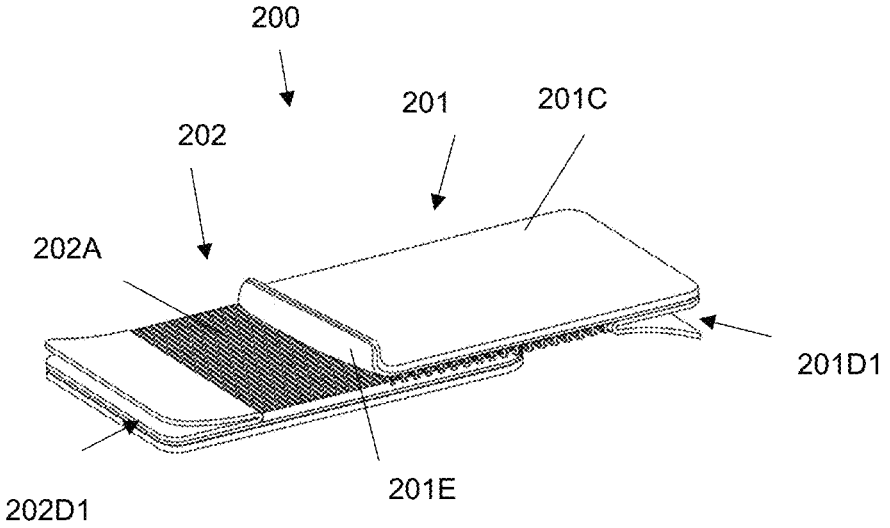
FIG. 12B is an illustrative perspective view showing the fastener in FIG. 12A with a gripping portion raised.

With reference to FIGS. 7A and 7B as well as FIGS. 12A and 12B, the hook tape 101/201 is placed on top of the loop tape 102/202 and the two are pressed against one another so as to allow the hook connectors 101A/201A on the hook tape 101/201 to engage, by way of hooking, onto the loop connectors 102A/202A of the loop tape 102/202. Overlapping between the hook tape 101/201 and the loop tape 102/202 is adjustable lengthwise so as to adjust the overall length of the fastener 100/200, hence the overall length of the connected arms of the brasserie. The greater the degree of the lengthwise overlapping between the hook and loop tapes 101/201/102/202, the shorter the overall length of the fastener 100/200.

FIGS. 1 to 3B show a hook tape 101 of the first embodiment of the fastener.

Figure 1:
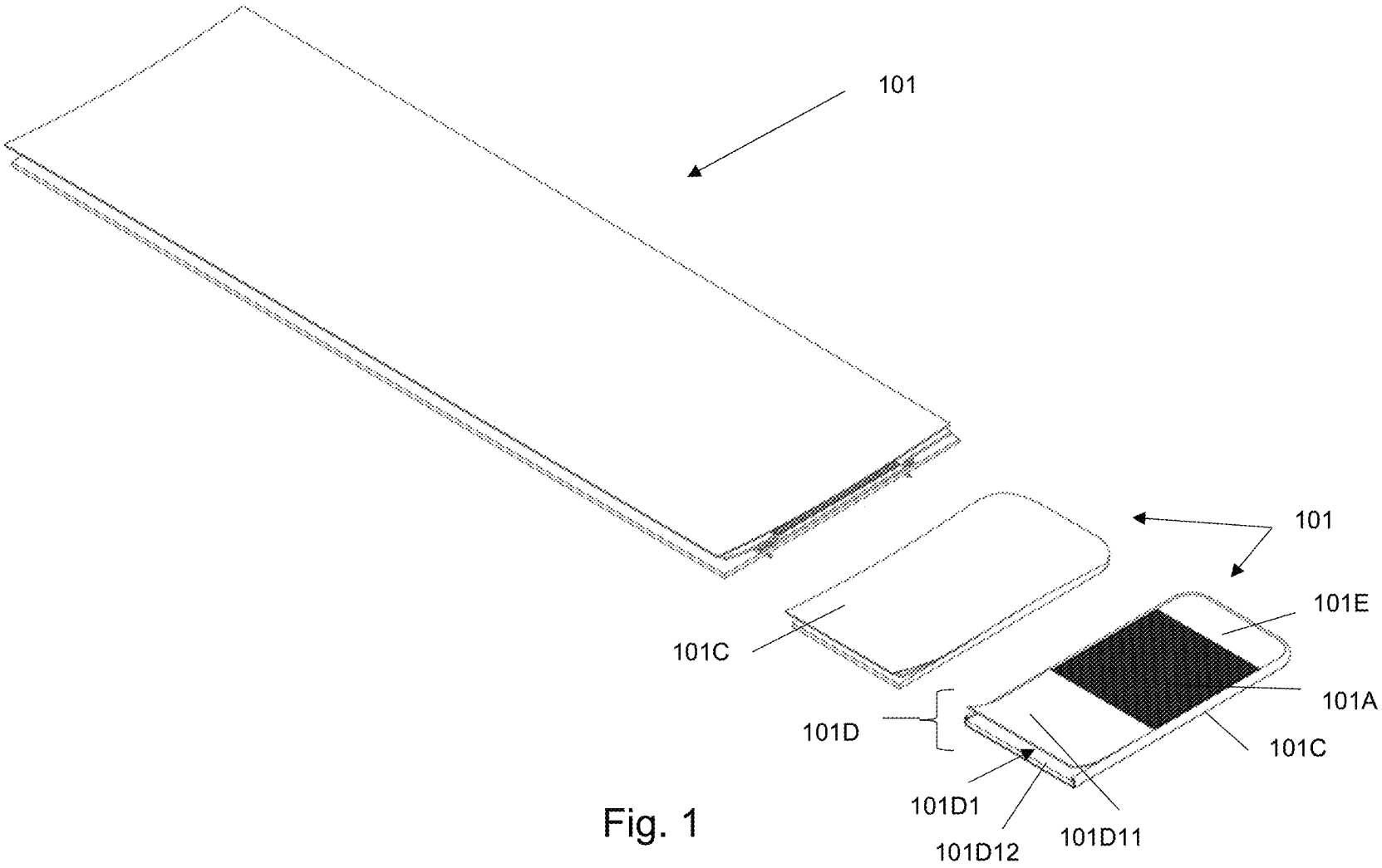
FIG. 1 is an illustrative perspective view of the formation of a hook tape of a first embodiment of a fastener in accordance with the invention.

Referring to FIG. 1, there is shown an elongated tape that is cut into hook tapes 101 of preferred dimension. As can be seen from the FIG. 1, the hook connectors 101A are concealed by a base layer 101C which has three sides attached to corresponding three sides of the support layer 101G/backing sheet 101B to form a pocket with an opened end. Through the opened end, the base layer 101C is moved or flipped to simultaneously reveal the hook connectors 101A and be placed underneath the support layer 101G.

In more detail, as shown in FIGS. 2A to 3B, the backing sheet 101B is placed over a support layer 101G and occupies the middle portion of the support layer 101G. One end of the hook tape 101 is provided with a gripping portion 101E. The gripping portion 101E is made of stretchable or elastic material and it is devoid of hook connectors 101A. The gripping portion 101E is fixed in position by attaching to an upper surface of the backing sheet 101B at one end portion and an upper surface of the support layer 101G at another end portion. Such attachment may be by way of a seam or adhesive. In this specific embodiment, one end of the gripping portion 101E is sewed onto the backing sheet 101B and the support layer 101G while the other end of the gripping portion 101E is ultrasonically welded to the upper surface of the support layer 101G which is not covered by the backing sheet 101B. The attachment portion 101D is provided at another end of the hook tape 101 opposite the gripping portion 101E, thereby defines a window through which the hook connectors 101A are exposed. The attachment portion 101D includes a retainer 101D1 defined by a gap between a folded layer of fabric 101D11 and a corresponding end portion 101D12 of the support layer 101G which is not covered by the backing sheet 101B. The fabric 101D11 is a lamination of two layers of fabric with different stretchabilities. A first layer being elastic and stretchable and a second layer being rigid and inelastic to offer support. This fabric 101D11 along with the end portion 101D12 of the support layer 101G forms a retainer 101D1 in the form of an opened end dimensioned to receive an arm of a brasserie. The fabric 101D11 is sewed onto the backing sheet 101B and the support layer 101G.

Figure 2A:
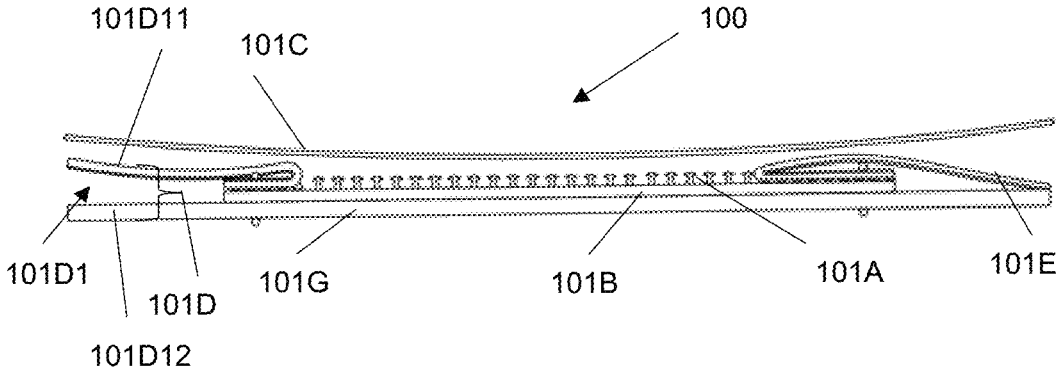
FIG. 2A is an illustrative cross-sectional view of the hook tape in FIG. 1 at a first state.
Figure 2B:
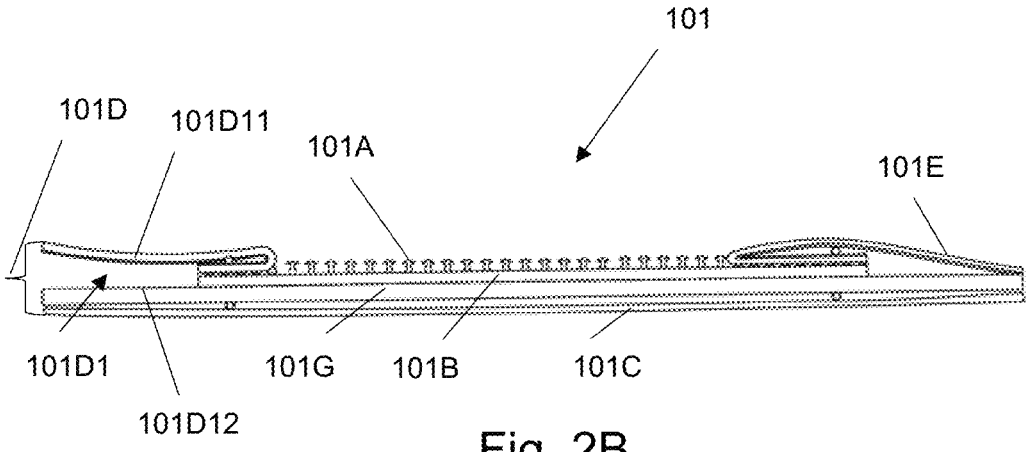
FIG. 2B is an illustrative cross-sectional view of the hook tape in FIG. 1 at a second state.
Figure 3A:
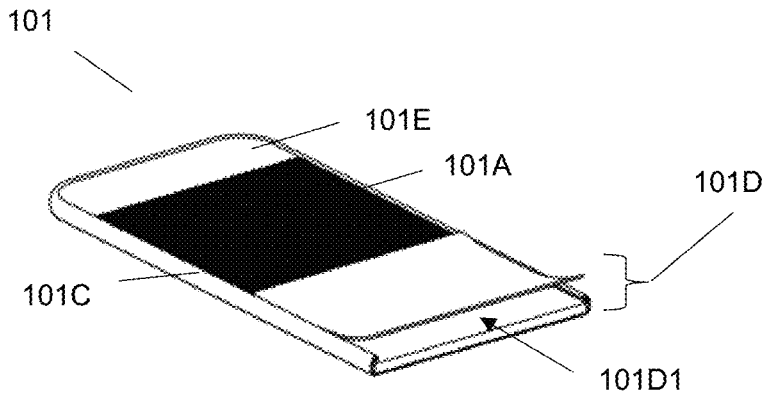
FIG. 3A is a perspective view of the hook tape in FIG. 2B.
Figure 3B:
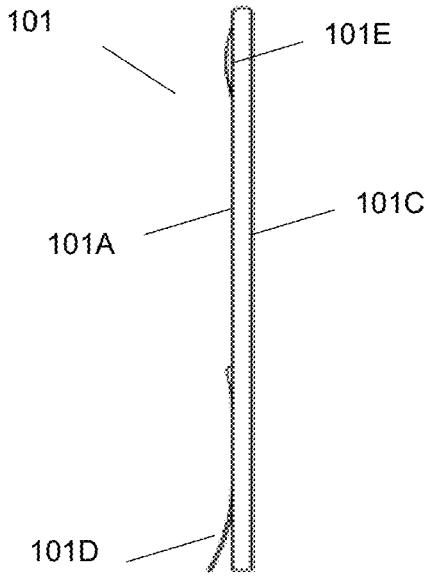
FIG. 3B is a side view of the hook tape in FIG. 2B.

In FIG. 2A, the base layer 101C is placed above and covers the attachment portion 101D, the gripping portion 101E and the hook connectors 101A. The base layer 101C is attached to the three sides of the layers underneath it to form a pocket. By flipping the base layer 101C inside out, simultaneously, the base layer 101C is placed under the support layer 101G whilst the hook connectors 101A, the gripping portion 101E and the attachment portion 101D are revealed. At the same time, the three edges where the base layer 101C is attached to the rest of the hook tape 101 are concealed as shown in FIGS. 2B to 3B. The base layer 101C may be attached to the support layer 101G in a further step by way of adhesive.

Referring to FIGS. 4 to 6C, there is shown a first embodiment of the loop tape 102.

Figure 4:
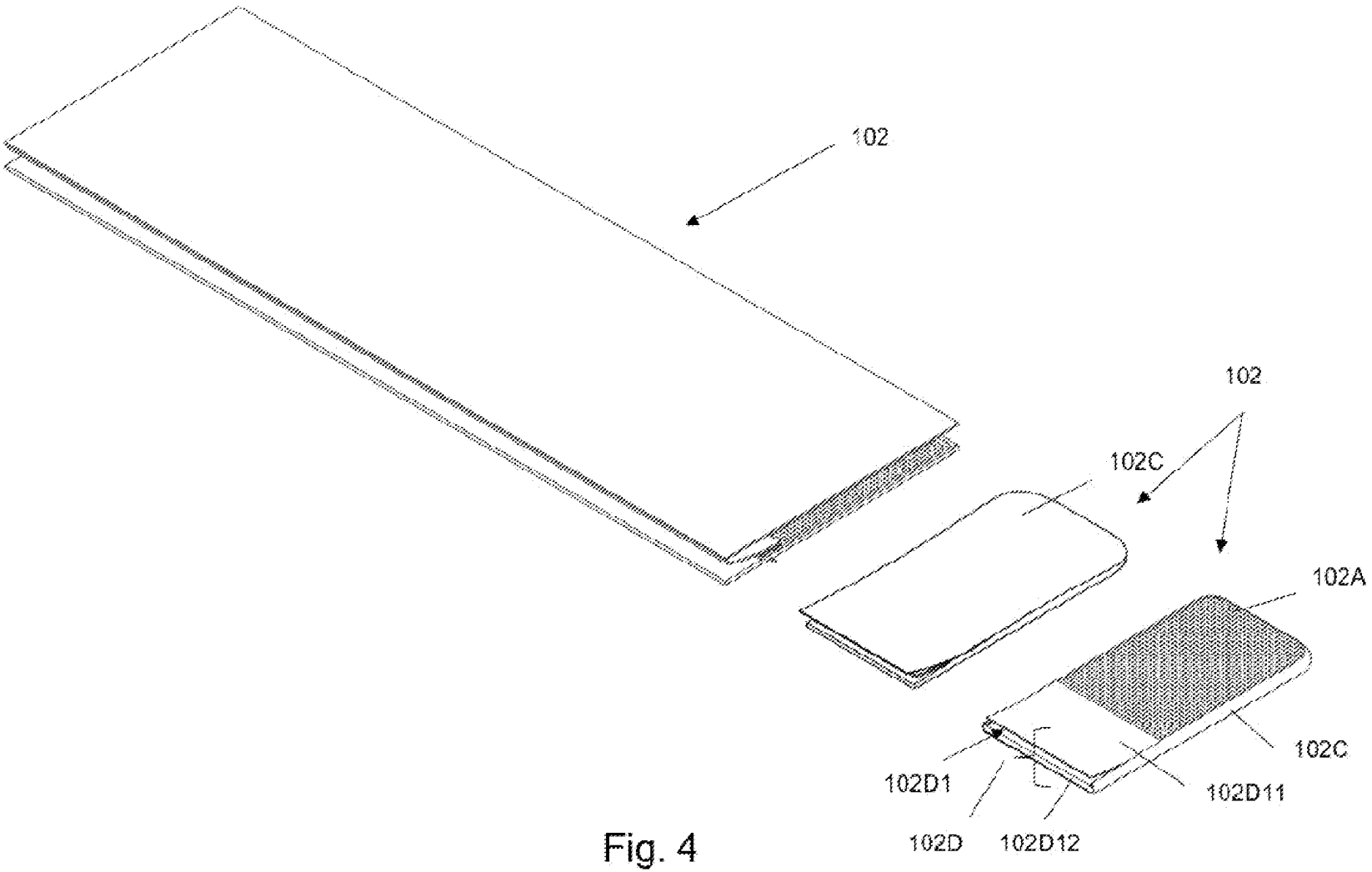
FIG. 4 is an illustrative perspective view of the formation of a loop tape of the first embodiment of the fastener in accordance with the invention.
Figure 5A:
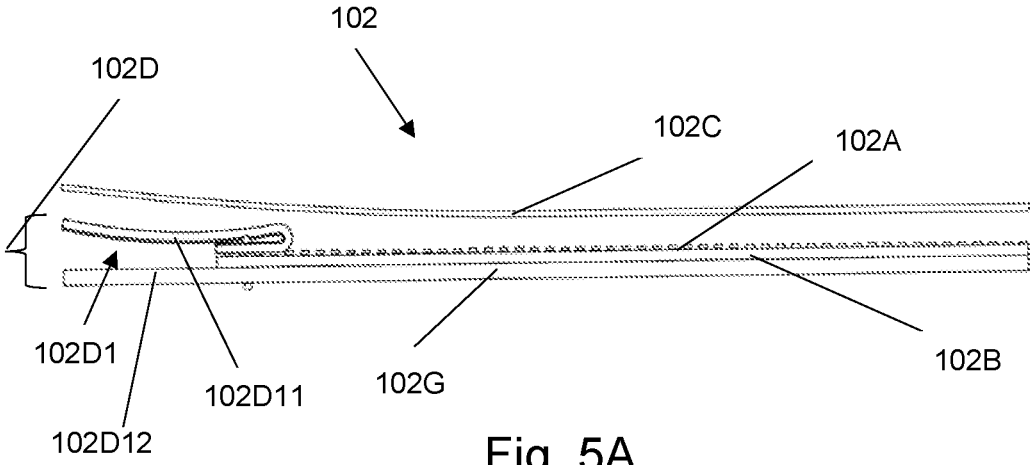
FIG. 5A is an illustrative cross-sectional view of the loop tape in FIG. 4 at the first state.
Figure 5B:
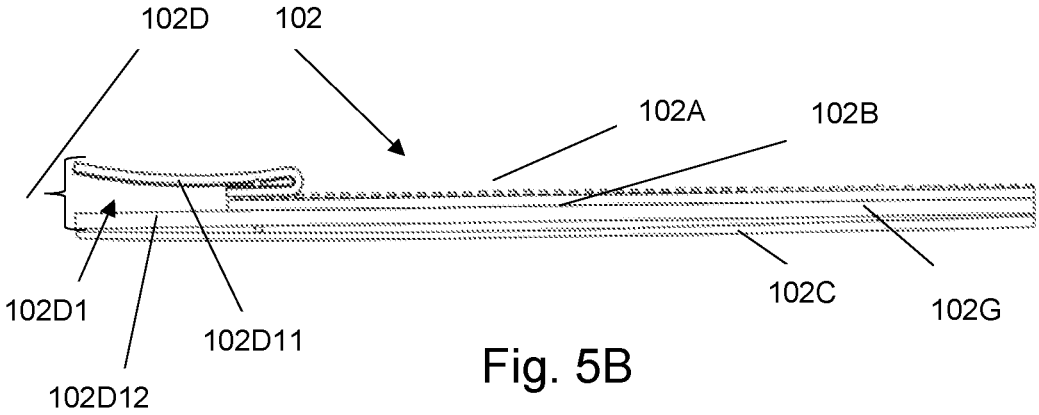
FIG. 5B is an illustrative cross-sectional view of the loop tape in FIG. 4 at its second state.
Figure 6A:
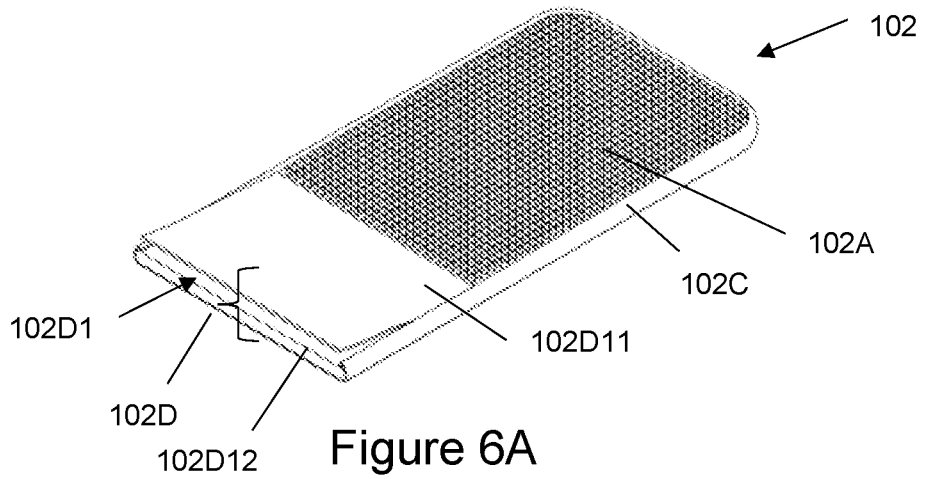
FIGS. 6A and 6B are illustrative perspective views of the loop tape in FIG. 4.
Figure 6B:
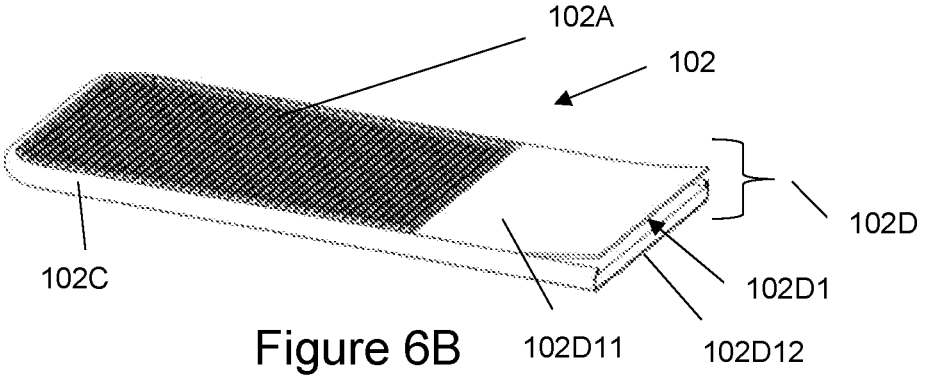
Figure 6C:
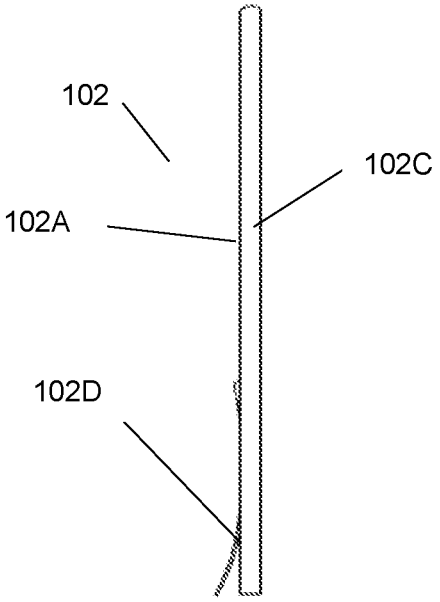
FIG. 6C is an illustrative side view of the loop tape in FIG. 4.

In FIG. 4, there is shown an elongated tape that is cut into loop tapes 102 of preferred dimension. As can be seen from the FIGS. 4 and 5A, the loop connectors 102A are concealed by a base layer 102C with three sides attached to corresponding three sides of the rest of the fastener 100 to form a pocket with an opened end. Through the opened end, the base layer 102C is moved or flipped to reveal the loop connectors 102A and being placed underneath the support layer 102G simultaneously.

In more detail, as shown in FIGS. 4 to 6C, the loop connectors 102A and its backing sheet 102B is placed over a support layer 102G and occupies most of an upper surface of the support layer 102G except an end portion where the attachment portion 102D is provided. The attachment portion 102D includes a retainer 102D1 defined by a folded layer of fabric 102D11 and a corresponding end portion 102D12 of the support layer 102G. The fabric 102D11 is a lamination of two layers of fabric with different stretchabilities. An upper layer being elastic and stretchable and a lower layer being rigid and inelastic to offer support. This fabric 102D11 along with the end portion 102D12 of the support layer 102G forms the retainer 102D in the form of an opened end dimensioned to receive an arm of a brasserie. One end of the fabric 102D11 is sewed onto the backing sheet 102B and the support layer 102G.

In FIG. 5A to 6C, the base layer 102C is placed above and covers the attachment portion 102D and the loop connectors 102A. The base layer 102C is attached to the three sides of the layers underneath it, which includes the backing sheet 102B and the support layer 102G to form a pocket. By flipping the base layer 102C inside out, the base layer 102C is placed under the support layer 102G, the loop connectors 102A and the attachment portion 102D are revealed simultaneously while three edges at which the base layer 102C is attached to the rest of the loop tape 102 are concealed by the base layer 102C. The base layer 102C may be attached to the support layer 102G in a further step by way of adhesive as shown.

With reference to FIGS. 7A and 7B, the gripping portion 101E offers a non-fastening portion that is devoid of any hook connectors 101A. The gripping portion 101E permits easy disconnection of the hook tape 101 from the loop tape 102 by offering a part to be held by fingers of a user for pulling the hook tape 101 from the hook tape 101 after the two are fastened. It also makes it easy to bring the hook tape 101 and the loop tape 102 together. In another embodiment, the gripping portion may be provided with the loop tape 102.

FIGS. 8 to 12B show a second embodiment of the fastener in accordance with the invention. The construction of the hook and loop tapes 201/202 in the second embodiment of the fastener is slightly different from that in the first embodiment as an adaptation for suiting different needs.

Figure 8:
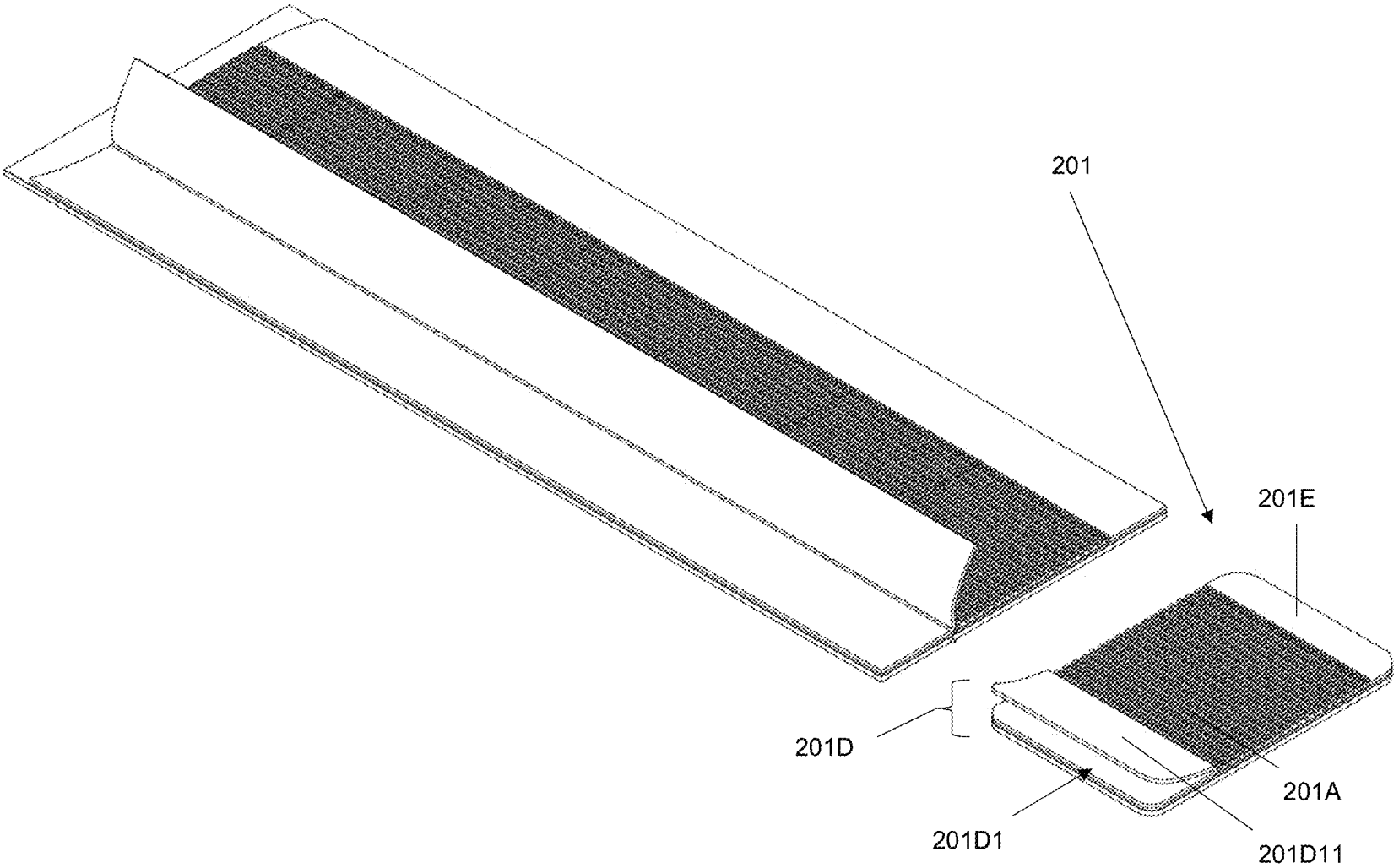
FIG. 8 is an illustrative perspective view of the formation of a hook tape of the second embodiment of the fastener in accordance with the invention.

Referring to FIG. 8, there is shown an elongated tape that is cut into hook tapes 201 of preferred dimension. As can be seen from the FIG. 8, the hook tape 201 is a lamination of various layers of material including a layer of hook connectors 201A supported by a backing sheet 201B which is positioned above a base layer 201C. The backing sheet 201B and the base layer 201C are attached to one another via a layer of heat sensitive adhesive material 201H.

Figure 9A:
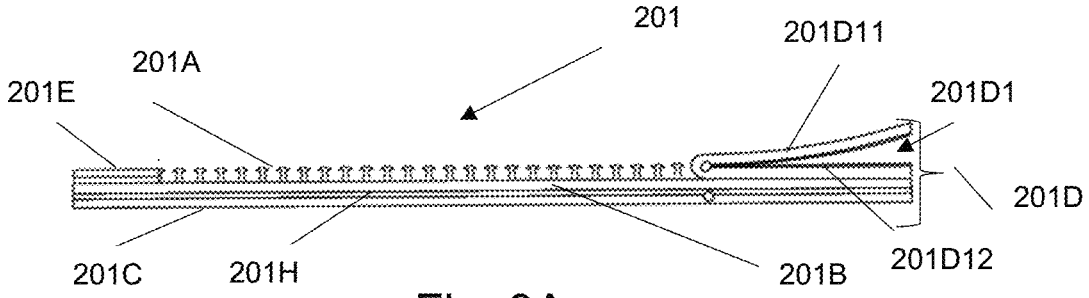
FIG. 9A is an illustrative cross-sectional view of the hook tape in FIG. 8.
Figure 9B:
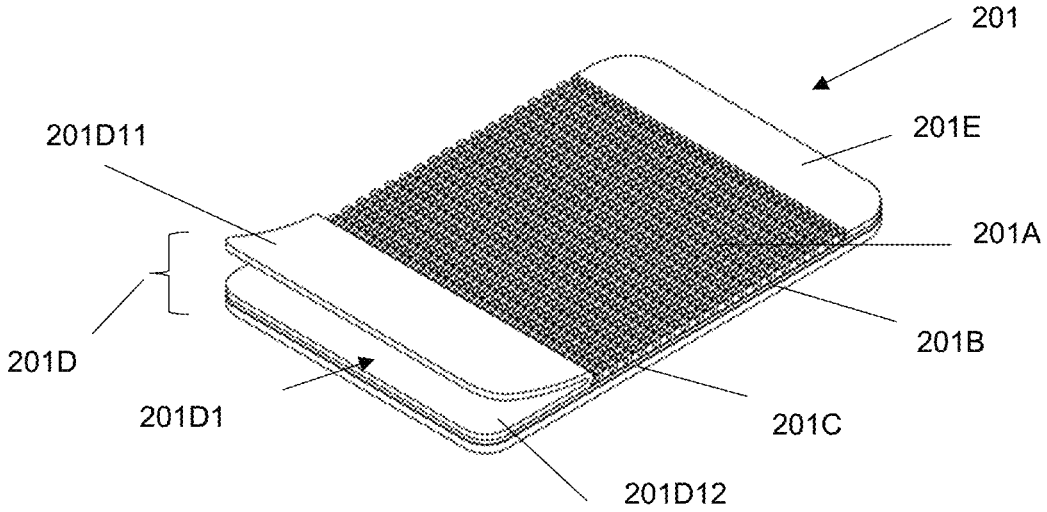
FIG. 9B is an illustrative perspective view of the hook tape in FIG. 8.
Figure 9C:
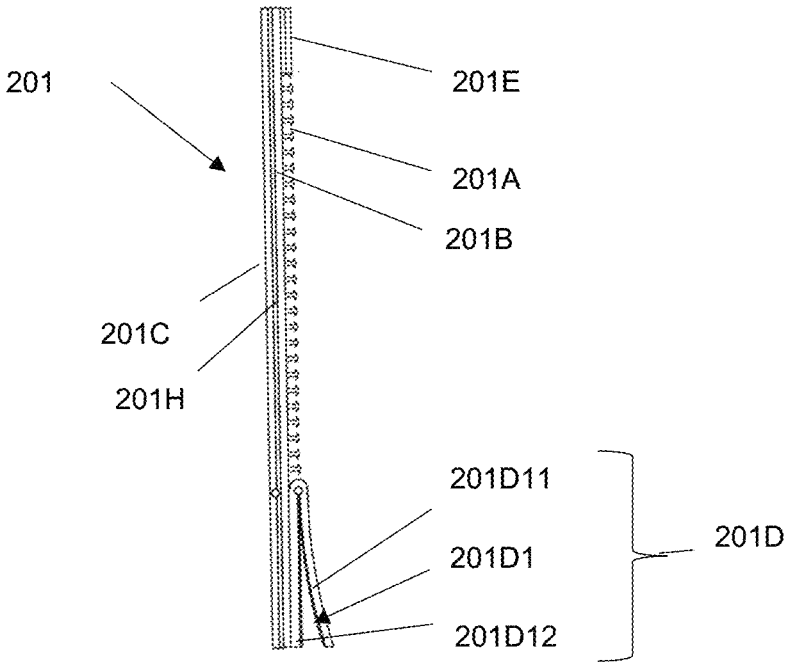
FIG. 9C is an illustrative side view of the hook tape in FIG. 8.

In more detail, as shown in FIGS. 9A to 9C, the hook connectors 201A occupy a middle portion of backing sheet 201B and the overall hook tape 201. The backing sheet 201B is of the same dimension as the base layer 201C for supporting a gripping portion 201E at one end and an attachment portion 201D at another end opposite that of the first mentioned end. The gripping portion 201E is a lamination of two layers of fabric with different strechabilities. A first layer of the fabric is a stretchable or elastic material supported by a second layer that is relatively more rigid and inelastic. The gripping portion 201E is devoid of hook connectors 201A and is fixed in position by adhesively attached to the backing sheet 201B. The attachment portion 201D and the gripping portion 201E define a window through which the hook connectors 201A are exposed. The attachment portion 201D includes a retainer 201D1 defined by a folded layer of fabric. The fabric 201D11 is a lamination of two layers of fabric with different stretchabilities. First layer is elastic and stretchable and a second layer being rigid and inelastic to offer support. The folded layer forms an opened end dimensioned to receive an arm of a brasserie. Lower portion of the folded layer is attached to the backing layer 201B by adhesive while the upper layer forms an upper surface of the fastener 200 along with the hook connectors 201A and the gripping portion 201E.

Figure 10:
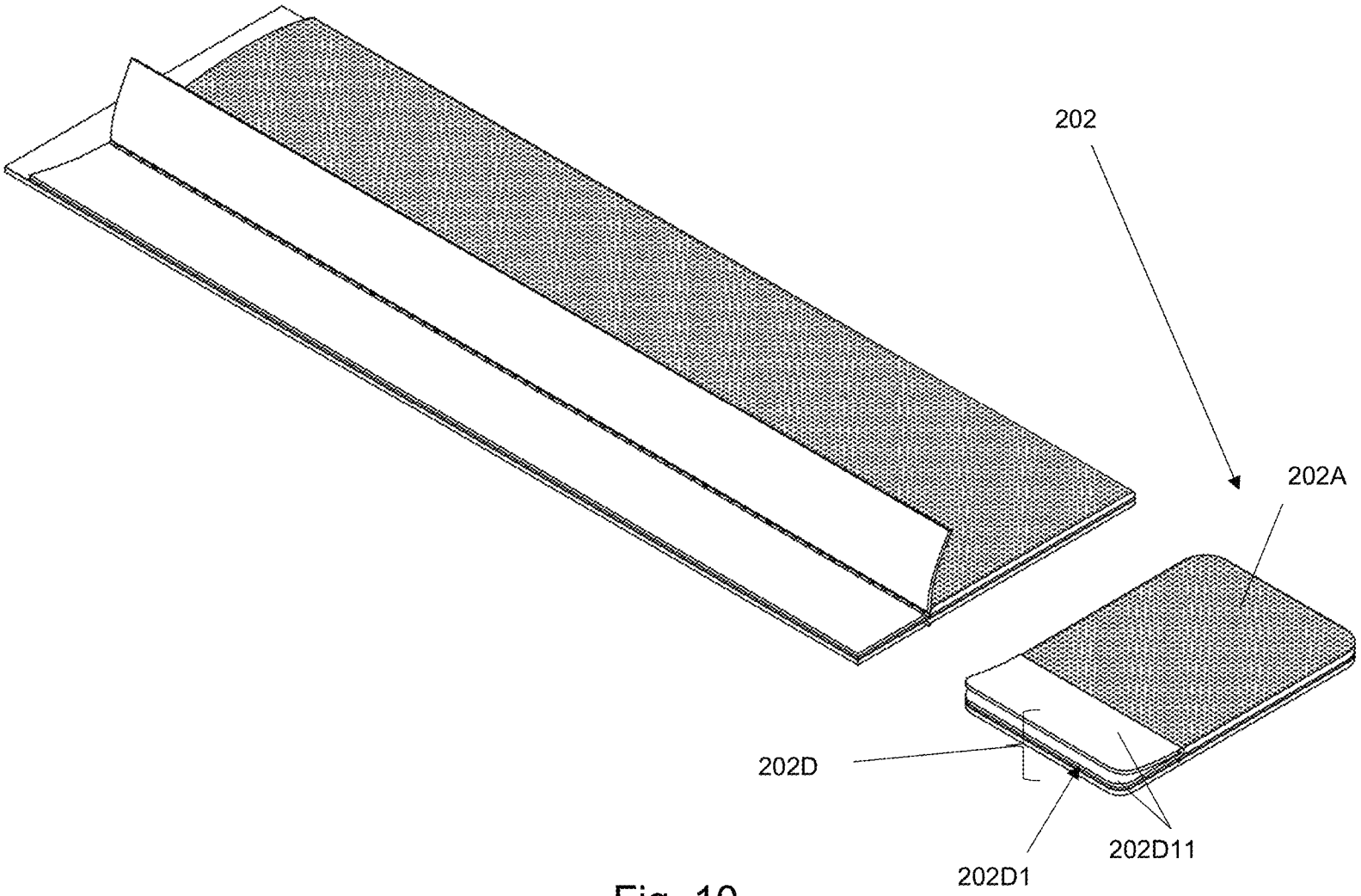
FIG. 10 is an illustrative perspective view of the formation of a loop tape of the second embodiment of the fastener in accordance with the invention.
Figure 11A:
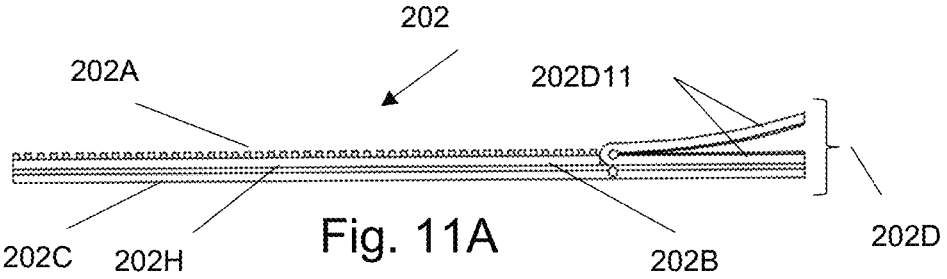
FIG. 11A is an illustrative cross-sectional view of the loop tape in FIG. 10.
Figure 11B:
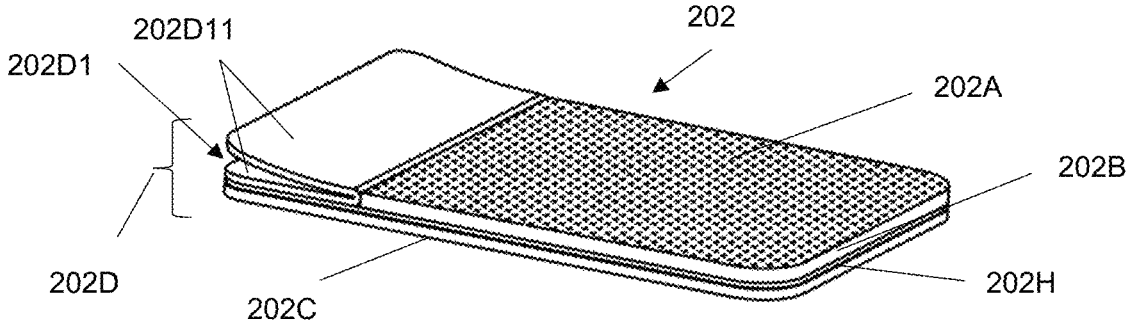
FIG. 11B is an illustrative perspective view of the loop tape in FIG. 10.
Figure 11C:
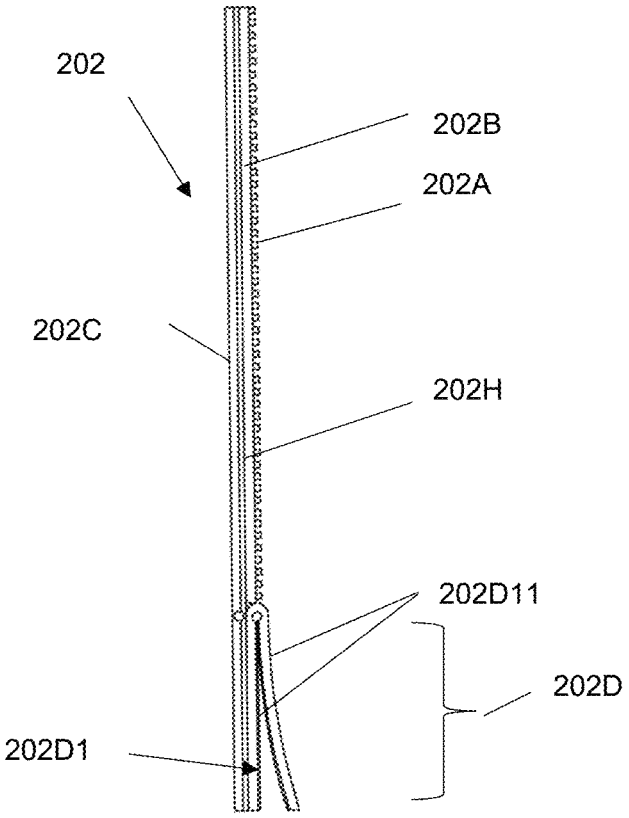
FIG. 11C is an illustrative side view of the loop tape in FIG. 10.

Referring to FIGS. 10 to 11C, there is shown a loop tape 202 of a second embodiment of the fastener 200. As can be seen from the figures, the loop tape 202 is a lamination of various layers of material including a layer of loop connectors 202A placed on top of a backing sheet 202B which is positioned above a base layer 202C. The backing sheet 202B and the base layer 202C are attached to one another by way of a layer of heat sensitive adhesive 202H.

In FIG. 10, there is shown an elongated tape that is cut into loop tapes 202 of preferred dimension. The backing sheet 202B along with the attachment portion 202D occupied the entire upper surface of the base layer 202C. The attachment portion 202D includes a retainer 202D1 defined by a folded layer of fabric 202D11. The fabric 202D11 is a lamination of two layers of fabric with different stretchabilities. First layer is elastic and stretchable and second layer is relatively rigid and inelastic to offer support. The folded layer forms an opened end dimensioned to receive an arm of a brasserie. Lower part of the folded layer is attached to the base layer 202C by adhesive while the upper layer forms an upper surface of the fastener which is devoid of any loop connectors 202A. The loop connectors 202A and the upper layer of the attachment portion 202D forms an upper surface of the fastener 202.

With reference to FIGS. 12A and 12B, the gripping portion 201E of the hook tape 201 offers a gripping portion that is devoid of any hook connectors 201A. The gripping portion 201E permits easy disconnection of the hook tape 201 from the loop tape 202 by offering a part to be held by fingers of a user for pulling the hook tape 201 from the loop tape 202 after the two are fastened. It also makes it easy to bring the hook tape 201 and the loop tape 202 together. In another embodiment, the gripping portion may be provided with the loop tape 202.

The invention has been given by way of example only, and various other modifications of and/or alterations to the described embodiment may be made by persons skilled in the art without departing from the scope of the invention as specified in the appended claims.

The invention claimed is:

1. A fastener for use with undergarment, comprising:

a first tape having a body provided with a plurality of first connectors;

a second tape having a body provided with a plurality of second connectors for connecting with the first connectors in the first tape; and each of the first and second tapes includes an attachment portion having a retainer adapted for connecting with said undergarment;

wherein the first and second connectors are self restorable;

wherein the attachment portion of each of the first and second tapes is provided at a first end of each of the first and second tapes; and the retainer of the attachment portion comprises a space defined by upper and lower layers of the attachment portion, the space is configured to receive a part of said undergarment.

2. The fastener as claimed in claim 1, wherein the plurality of first connectors is provided adjacent the attachment portion of the first tape.

3. The fastener as claimed in claim 2, wherein the plurality of first connectors and the attachment portion of the first tape are in connection with a base layer.

4. The fastener as claimed in claim 3, wherein the base layer is formed from a layer of stretchable material.

5. The fastener as claimed in claim 3, wherein the base layer is movable from a first position in which the first plurality of connectors is concealed, to a second position in which the first plurality of connectors is exposed.

6. The fastener as claimed in claim 3, wherein the base layer is attached to the plurality of first connectors by way of adhesive.

7. The fastener as claimed in claim 3, wherein the base layer is fixed to the plurality of first connectors via a support layer.

8. The fastener as claimed in claim 2, wherein the first tape includes a gripper portion provided opposite to the attachment portion of the first tape for manipulating by fingers of a user.

9. The fastener as claimed in claim 8, wherein the gripping portion is devoid of the first connectors.

10. The fastener as claimed in claim 9, wherein at least a part of the gripping portion includes a layer of stretchable material.

11. The fastener as claimed in claim 1, wherein the attachment portion of each of the first and second tapes includes a lamination of two layers of materials with different stretchabilities.

12. The fastener as claimed in claim 1, wherein the plurality of first connectors is supported on a backing sheet.

13. The fastener as claimed in claim 12, wherein the attachment portion of the first tape is sewed onto said backing sheet and a base layer.

14. The fastener as claimed in claim 1, wherein the plurality of first connectors comprise self restorable hook connectors and the plurality of second connectors comprise self restorable loop connectors for engaging the hook connectors.

15. A method of manufacturing a first tape as claimed in claim 1 comprising the steps of: providing a layer of first self restorable connectors; attaching the layer of first self restorable connectors onto a support layer; attaching a base layer to at least one of the layer of first self restorable connectors and the support layer at three sides of the base layer; moving the base layer from a first position to a second position to simultaneously expose the layer of first self restorable connectors, place the base layer under the support layer and conceal the three sides at which the base layer is attached to the layer of first self restorable connectors and the support layer.

16. The method as claimed in claim 15 further comprising the step of forming a gripping portion adjacent the layer of first self restorable connectors.

17. The fastener as claimed in claim 1, wherein the first and second tapes are hook and loop tapes.

18. A fastener for use with undergarment, comprising: a first tape having a body provided with a plurality of first connectors; a second tape having a body provided with a plurality of second connectors for connecting with the first connectors in the first tape; and each of the first and second tapes includes an attachment portion having a retainer adapted for connecting with said undergarment; wherein the first and second connectors are self-restorable; wherein the attachment portion of each of the first and second tapes includes a lamination of two layers of materials with different stretchabilities.

19. A fastener for use with undergarment, comprising: a first tape having a body provided with a plurality of first connectors; a second tape having a body provided with a plurality of second connectors for connecting with the first connectors in the first tape; and each of the first and second tapes includes an attachment portion having a retainer adapted for connecting with said undergarment; wherein the first and second connectors are self-restorable; wherein the plurality of first connectors are provided adjacent the attachment portion; the first tape includes a gripper portion provided opposite to the attachment portion of the first tape for manipulating by fingers of a user; and the gripping portion is devoid of the plurality of first connectors.

20. A fastener for use with undergarment, comprising: a first tape having a body provided with a plurality of first connectors; a second tape having a body provided with a plurality of second connectors for connecting with the first connectors in the first tape; and each of the first and second tapes includes an attachment portion having a retainer adapted for connecting with said undergarment; wherein the first and second connectors are self-restorable; wherein the attachment portion is provided at a first end of each of the first and second tapes; wherein the plurality of first connectors are supported on a backing sheet; and the attachment portion of the first tape is sewn onto said backing sheet and a base layer.

* * * * *